US006637872B2

(12) United States Patent
Ara et al.

(10) Patent No.: US 6,637,872 B2
(45) Date of Patent: Oct. 28, 2003

(54) INK TANK, INK JET RECORDING HEAD, INK JET CARTRIDGE, AND INK JET RECORDING APPARATUS

(75) Inventors: Yohji Ara, Kanagawa (JP); Hiroyuki Inoue, Kanagawa (JP); Hideo Fukazawa, Kanagawa (JP); Tetsuji Kurata, Kanagawa (JP); Hirofumi Hirano, Kanagawa (JP); Hiroshi Netsu, Kanagawa (JP); Hideaki Okamoto, Kanagawa (JP); Masaya Uetsuki, Kanagawa (JP); Hiroki Hayashi, Kanagawa (JP); Noriyasu Asaki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/840,165

(22) Filed: Apr. 24, 2001

(65) Prior Publication Data

US 2001/0045976 A1 Nov. 29, 2001

(30) Foreign Application Priority Data

Apr. 26, 2000 (JP) ..... 2000-126598

(51) Int. Cl.[7] ..... B41J 2/175
(52) U.S. Cl. ..... 347/85
(58) Field of Search ..... 347/85, 86, 87, 347/94, 84

(56) References Cited

U.S. PATENT DOCUMENTS

| | | | | | |
|---|---|---|---|---|---|
| 4,187,511 | A | | 2/1980 | Robinson | 347/7 |
| 5,489,925 | A | * | 2/1996 | Brooks et al. | 347/6 |
| 5,663,754 | A | | 9/1997 | Lorenze, Jr. et al. | 347/87 |
| 5,701,149 | A | * | 12/1997 | Pagnon et al. | 347/89 |
| 5,790,158 | A | * | 8/1998 | Shinada et al. | 347/86 |
| 5,801,735 | A | * | 9/1998 | Lorenze et al. | 347/85 |
| 5,801,737 | A | * | 9/1998 | Sato et al. | 347/86 |
| 5,967,045 | A | | 10/1999 | Staiger et al. | 101/366 |
| 6,050,682 | A | | 4/2000 | Pawlowski, Jr. | 347/92 |
| 6,302,516 | B1 | * | 10/2001 | Brooks et al. | 347/35 |
| 6,540,321 | B1 | * | 4/2003 | Hirano et al. | 347/22 |

FOREIGN PATENT DOCUMENTS

| | | |
|---|---|---|
| EP | 623472 | 11/1994 |
| EP | 803 362 | * 10/1997 |
| EP | 1 057 644 | * 12/2000 |
| JP | 61-024458 | 2/1986 |
| JP | 7-329316 | 12/1995 |
| JP | 8-187874 | 7/1996 |
| JP | 9-020013 | 1/1997 |
| JP | 11-240180 | 9/1999 |
| WO | 95/12109 | 5/1995 |

OTHER PUBLICATIONS

U.S. Publication No. 2002/0012030, dated Jan. 31, 2002, Okamoto et al., All Pages.
U.S. Publication No. 2001/0040610, dated Nov. 15, 2001 Kurata et al., All Pages.

* cited by examiner

*Primary Examiner*—Michael Nghiem
(74) *Attorney, Agent, or Firm*—Fitzpatrick, Cella, Harper & Scinto

(57) ABSTRACT

An ink jet recording apparatus has a pressure limiting mechanism between a gas-liquid separator and a source of negative pressure required to suck and supply ink for refilling an ink tank, to prevent a fixed amount or more of negative pressure from being exerted on the gas-liquid separator.

7 Claims, 14 Drawing Sheets

INK TANK, INK JET RECORDING HEAD, INK JET CARTRIDGE, AND INK JET RECORDING APPARATUS

This application is based on Patent Application No. 2000-126598 filed Apr. 26, 2000 in Japan, the content of which is incorporated hereinto by reference.

BACKGROUND OF THE INVENTION

1. Field of the Invention

The present invention relates to an ink tank, an ink jet recording head, an ink jet cartridge, and an ink jet recording apparatus.

The present invention is applicable to general print apparatuses as recording apparatuses, copiers, facsimile terminal equipment having a communication system, apparatuses such as word processors which have a print section, and industrial print apparatuses combined with various processing apparatuses.

2. Description of the Related Art

Known serial-scan-based ink jet recording apparatuses comprise a carriage that is movable in a main scan direction, an ink jet recording head acting as recording means, and an ink tank acting as an ink container, both the ink jet recording head and the ink tank being replaceably mounted on the carriage. The recording head and the ink tank are connected together via an ink passage. In such a recording apparatus, an image can sequentially be recorded on a recorded medium such as recording paper by repeating a main scan of the carriage with the recording head and the ink tank mounted thereon and a subscan of the recorded medium.

On the other hand, a possible method of supplying an ink to the ink tank of the ink jet recording apparatus is, for example, to suck and supply the ink by pressurizing the ink to introduce negative pressure into the ink.

One configuration that can be used if the ink is sucked and supplied as described above will be described below as a method for supplying an ink to an ink tank a the recording head connected thereto.

As shown in FIG. 9, in, for example, a serial-scan-based ink jet recording apparatus, a storage ink tank 20 acting as a sub-ink tank has an ink jet recording head 20*a* (hereafter simply referred to as a "recording head") capable of ejecting an ink for recording and is removably mounted on a carriage (not shown). The recording head 20*a* ejects the ink from the storage ink tank 20 through an ink ejecting port in a nozzle 44 based on image information. Further, the storage ink tank 20 has an ink supplying port 20*f* for supplying the ink from the storage ink tank 20 to the recording head 20*a*. The nozzle 44 in the recording head 20*a* includes an ejection energy generating means for generating energy required to eject the ink. The ejection energy generating means may comprise an electrothermal converter for generating thermal energy. The carriage is moved by an appropriate movement mechanism in the main scan direction shown by arrows 28 and 35. Further, recorded media are conveyed in a subscan direction crossing the main scan direction.

In such a recording apparatus, an image can sequentially be recorded on the recorded medium by repeating a main scan of the carriage with the recording head 20*a* and the storage ink tank 20 mounted thereon and a subscan of the recorded medium.

The storage ink tank 20 has a suction port 53 and an ink intake port 20*b* formed in a side thereof. The suction port 53 is in communication with the interior of the storage ink tank 20 via a suction passage 53*a*, and a gas transmitting member 48 is provided at the site of the opening of the suction passage 53*a* in the storage ink tank 20. The gas transmitting member 48 has, as a gas-liquid separating means, a function of transmitting gases therethrough while not transmitting inks therethrough. For example, the gas transmitting member 48 preferably comprise a thin sheet formed of an ethylene tetrafluorice resin, a similar porous resin material, or the like. Additionally, the storage ink tank 20 has an ink absorber 41*a* accommodated therein, for sucking and holding the ink.

The storage ink tank 20 includes a filter 103 and a valve 104 in the supplying port 20*f*. The valve 104 is shaped like a seat and has its proximal end welded to the filter 103. The valve 104 functions to open and close the supplying port 20*f* depending on the internal pressure of the storage ink tank 20.

Further, a main tank 22 of the recording apparatus main body is disposed via a tube 21*a* with a supplying joint 101, so as to be connectable to the ink intake port 20*b* in the storage ink tank 20. The joint 101 and a joint 102 are disposed in the recording apparatus main body so as to lie opposite to the ink intake port 20*b* and the suction port 53 in the scan direction 35 of the carriage.

During a recording operation, the valve 104 is open and the ink is supplied from the storage ink tank 20 to the recording head 20*a*, as shown in FIG. 9.

FIGS. 10 to 14 are views useful in explaining an operation of refilling the above described ink tank with the ink.

In ink refilling, the carriage is first moved in the direction of the arrow 28 to connect the ink intake port 20*b* and the suction port 53 to the corresponding joints 101 and 102, as shown in FIG. 10. Subsequently, the suction pump 31 performs a suction operation to suck air from the storage ink tank 20 via the gas transmitting member 48 to set the interior of the storage ink tank 20 at negative pressure. The negative pressure in the storage ink tank 20 causes the ink in the main tank 22 to be sucked to the interior of the storage ink tank 20 as shown in FIGS. 11 and 12.

In this case, the negative pressure in the storage ink tank 20 causes the valve 104 to operate in such a way as to close the supplying port 20*f*, as shown in FIGS. 11 and 12. Accordingly, the ink in the recording head 20*a* is not sucked to the interior of the storage ink tank 20, and ink meniscus formed at the ink ejecting port in the recording head 20*a* is not destroyed. Further, air does not enter the recording head 20*a* or the storage ink tank 20 through the ink ejecting port. This ensures that the ink is sucked from the main tank 22 and supplied to the interior of the storage ink tank 20.

Then, as shown in FIG. 13, when the level 41*b* of the ink in the storage ink tank 20 reaches the gas transmitting member 48, the ink refilling is automatically stopped because the gas transmitting member 48 does not transmit liquids such as inks therethrough. Subsequently, as shown in FIG. 14, the carriage moves in the direction of the arrow 35 to separate the ink intake port 20*b* and the suction port 53 from the corresponding joints 101 and 102, thereby completing the series of refilling operations.

The above-described conventional ink tank, however, has the following problems:

That is, as described above, when the level 41*b* of the ink in the storage ink tank 20 reaches the gas transmitting member 48, the ink refilling is automatically stopped because the gas transmitting member 48 does not transmit liquids such as inks therethrough. For a certain gas transmitting member 48, exerting a certain amount or more of negative pressure may destroy the gas transmitting member 48 to eliminate its inherent function of separating a gas and a liquid from each other, thus causing the ink, a liquid, to be also sucked. Consequently, a large amount of ink may be sucked from the storage ink tank 20 to waste the ink, the ink may flow into the suction pump 31 to destroy it, or a waste ink may contaminate the recording apparatus.

It is thus an object of the present invention to provide an ink tank, an ink jet recording head, an ink jet cartridge, and an ink jet recording apparatus which are durable enough to allow the ink tank to be refilled many times and which prevent the original gas-liquid separating function of a gas transmitting member as a gas-liquid separating means from being destroyed due to excessive negative pressure exerted on the gas transmitting means as described above, thereby achieving an appropriate ink refilling operation and a reliable ink sucking and supplying operation.

SUMMARY OF THE INVENTION

To attain the above object, the present invention provides an ink tank which supplies an ink to an ink jet recording head via an ink supplying port, which can supply the ink by introducing negative pressure thereinside, and which has a gas-liquid separating means in a suction port through which the negative pressure required to suck and supply the ink is introduced, the gas-liquid separating means transmitting gases therethrough while not transmitting the gas therethrough, the ink tank being characterized by having a fixed-negative-pressure generating means provided between the gas-liquid separating means and a source of the negative-pressure required to suck and supply the ink, the fixed-negative-pressure generating means preventing a fixed amount or more of negative pressure from being exerted on the gas-liquid separating means. This provides an ink tank which is durable enough to be refilled with the ink many times and which prevents the original gas-liquid separating function of the gas transmitting member as a gas-liquid separating means from being destroyed due to excessive negative pressure exerted on the gas transmitting member, thereby achieving an appropriate ink refilling operation and a reliable ink sucking and supplying operation.

The ink tank of the present invention is also characterized by including as the fixed-negative-pressure generating means, a suction pump having a negative-pressure sensor. This prevents the original gas-liquid separating function of the gas transmitting member as a gas-liquid separating means from being destroyed due to excessive negative pressure exerted on the gas transmitting member, thereby achieving an appropriate ink refilling operation and a reliable ink sucking and supplying operation.

The ink tank of the present invention is further characterized by including a tube pump as the fixed-negative-pressure generating means. This prevents the original gas-liquid separating function of the gas transmitting member as a gas-liquid separating means from being destroyed due to excessive negative pressure exerted on the gas transmitting member, thereby achieving an appropriate ink refilling operation and a reliable ink sucking and supplying operation.

The ink tank of the present invention is further characterized by including a diaphragm pump as the fixed-negative-pressure generating means. This prevents the original gas-liquid separating function of the gas transmitting member as a gas-liquid separating means from being destroyed due to excessive negative pressure exerted on the gas transmitting member, thereby achieving an appropriate ink refilling operation and a reliable ink sucking and supplying operation.

The present invention provides an ink jet recording head installed on an ink tank which supplies an ink to an ink jet recording head via an ink supplying port, which can supply the ink by introducing negative pressure thereinside, and which has a gas-liquid separating means in a suction port through which the negative pressure required to suck and supply the ink is introduced, the gas-liquid separating means transmitting gases therethrough while not transmitting the gas therethrough, the ink jet recording head being characterized by having a fixed-negative-pressure generating means provided between the gas-liquid separating means and a source of the negative-pressure required to suck and supply the ink, the fixed-negative-pressure generating means preventing a fixed amount or more of negative pressure from being exerted on the gas-liquid separating means. This prevents the original gas-liquid separating function of the gas transmitting member as a gas-liquid separating means from being destroyed due to excessive negative pressure exerted on the gas transmitting member, thereby achieving an appropriate ink refilling operation and a reliable ink sucking and supplying operation.

The ink jet recording head of the present invention is also characterized by including as the fixed-negative-pressure generating means, a suction pump having a negative-pressure sensor. This enables the ink jet recording head to be appropriately produced so as to have a simple configuration, thereby achieving an appropriate ink refilling operation and a reliable ink sucking and supplying operation.

The ink jet recording head of the present invention is further characterized by including a tube pump as the fixed-negative-pressure generating means. This enables the ink jet recording head to be appropriately produced so as to have a simple configuration, thereby achieving an appropriate ink refilling operation and a reliable ink sucking and supplying operation.

The ink jet recording head of the present invention is further characterized by having a diaphragm pump as the fixed-negative-pressure generating means. This enables the ink jet recording head to be appropriately produced so as to have a simple configuration.

The present invention provides an ink jet cartridge having an ink tank installed therein, which supplies an ink to an ink jet recording head via an ink supplying port, which can supply the ink by introducing negative pressure thereinside, and which has a gas-liquid separating means in a suction port through which the negative pressure required to suck and supply the ink is introduced, the gas-liquid separating means transmitting gases therethrough while not transmitting the gas therethrough, the ink jet cartridge being characterized by having a fixed-negative-pressure generating means provided between the gas-liquid separating means and a source of the negative-pressure required to suck and supply the ink, the fixed-negative-pressure generating means preventing a fixed amount or more of negative pressure from being exerted on the gas-liquid separating means. This enables the ink jet cartridge to be appropriately produced so as to have a simple configuration, and prevents the original gas-liquid separating function of the gas transmitting member as a gas-liquid separating means from being destroyed due to excessive negative pressure exerted on the gas transmitting member, thereby achieving an appropriate ink refilling operation and a reliable ink sucking and supplying operation.

The ink jet cartridge of the present invention is also characterized by including as the fixed-negative-pressure generating means, a suction pump having a negative-pressure sensor. This enables the ink jet cartridge to be appropriately produced so as to have a simple configuration, thereby achieving an appropriate ink refilling operation and a reliable ink sucking and supplying operation.

The ink jet cartridge of the present invention is further characterized by including a tube pump as the fixed-negative-pressure generating means. This enables the ink jet cartridge to be appropriately produced so as to have a simple configuration, thereby achieving an appropriate ink refilling operation and a reliable ink sucking and supplying operation.

The ink jet cartridge of the present invention is further characterized by including a diaphragm pump as the fixed-negative-pressure generating means. This enables the ink jet cartridge to be appropriately produced so as to have a simple configuration, thereby achieving an appropriate ink refilling operation and a reliable ink sucking and supplying operation.

The ink jet cartridge of the present invention is further characterized by having a diaphragm pump as the fixed-negative-pressure generating means. This enables the ink jet cartridge to be appropriately produced so as to have a simple configuration.

The present invention provides an ink jet recording apparatus having an ink tank which supplies an ink to an ink jet recording head via an ink supplying port and which can supply the ink by introducing negative pressure thereinside, the ink jet recording apparatus having a gas-liquid separating means in a suction port through which the negative pressure required to suck and supply the ink is introduced, the gas-liquid separating means transmitting gases therethrough while not transmitting the gas therethrough, the ink jet recording apparatus being characterized by having a fixed-negative-pressure generating means provided between the gas-liquid separating means and a source of the negative-pressure required to suck and supply the ink, the fixed-negative-pressure generating means preventing a fixed amount or more of negative pressure from being exerted on the gas-liquid separating means. This provides an ink jet recording apparatus which is durable enough to be refilled with the ink many times and which prevents the original gas-liquid separating function of the gas transmitting member as a gas-liquid separating means from being destroyed due to excessive negative pressure exerted on the gas transmitting member, thereby achieving an appropriate ink refilling operation and a reliable ink sucking and supplying operation.

The ink jet recording apparatus of the present invention is also characterized by including as the fixed-negative-pressure generating means, a suction pump having a negative-pressure sensor. This serves to achieve an appropriate ink refilling operation and a reliable ink sucking and supplying operation, and enables the ink jet recording apparatus to be appropriately produced so as to have a simple configuration.

The ink jet recording apparatus of the present invention is further characterized by including a tube pump as the fixed-negative-pressure generating means. This serves to achieve an appropriate ink refilling operation and a reliable ink sucking and supplying operation.

The ink jet recording apparatus of the present invention is further characterized by having a diaphragm pump as the fixed-negative-pressure generating means. This allows the ink to flow appropriately to achieve stable ink refilling and supplying operations.

The above and other objects, features and advantages of the present invention will become more apparent from the following description of embodiments thereof taken in conjunction with the accompanying drawings.

DETAILED DESCRIPTION OF THE PREFERRED EMBODIMENTS

The present invention provides an ink tank, an ink jet recording head, an ink jet cartridge, and an ink jet recording apparatus; the present invention provides an ink tank which supplies an ink to the ink jet recording head via an ink supplying port, which can supply the ink by introducing negative pressure thereinside, and which has a gas-liquid separating means in a suction port through which the negative pressure required to suck and supply the ink is introduced, the gas-liquid separating means transmitting gases therethrough while not transmitting the gas therethrough, wherein the ink tank has a fixed-negative-pressure limiting means provided between the gas-liquid separating means and a source of the negative-pressure required to suck and supply the ink, the fixed-negative-pressure limiting means comprising a suction pump, a tube pump, a diaphragm pump or the like which has a negative-pressure sensor and preventing a fixed amount or more of negative pressure from being exerted on the gas-liquid separating means. This provides a compact and reliable ink jet recording apparatus which is durable enough to be refilled with the ink many times and which prevents the original gas-liquid separating function of the gas transmitting member as a gas-liquid separating means from being destroyed due to excessive negative pressure exerted on the gas transmitting member, thereby achieving an appropriate ink refilling operation and a reliable ink sucking and supplying operation.

An embodiment of the ink tank, ink jet recording head, ink jet cartridge, and ink jet recording apparatus of the present invention will be described below in detail with reference to the drawings.

In the embodiment described below, a serial-scan-based ink jet recording apparatus will be explained by way of example.

Embodiment 1

An integral part of the serial-scan-based ink jet recording apparatus of the present invention will be shown based on FIGS. 1 to 6.

Figure 1:
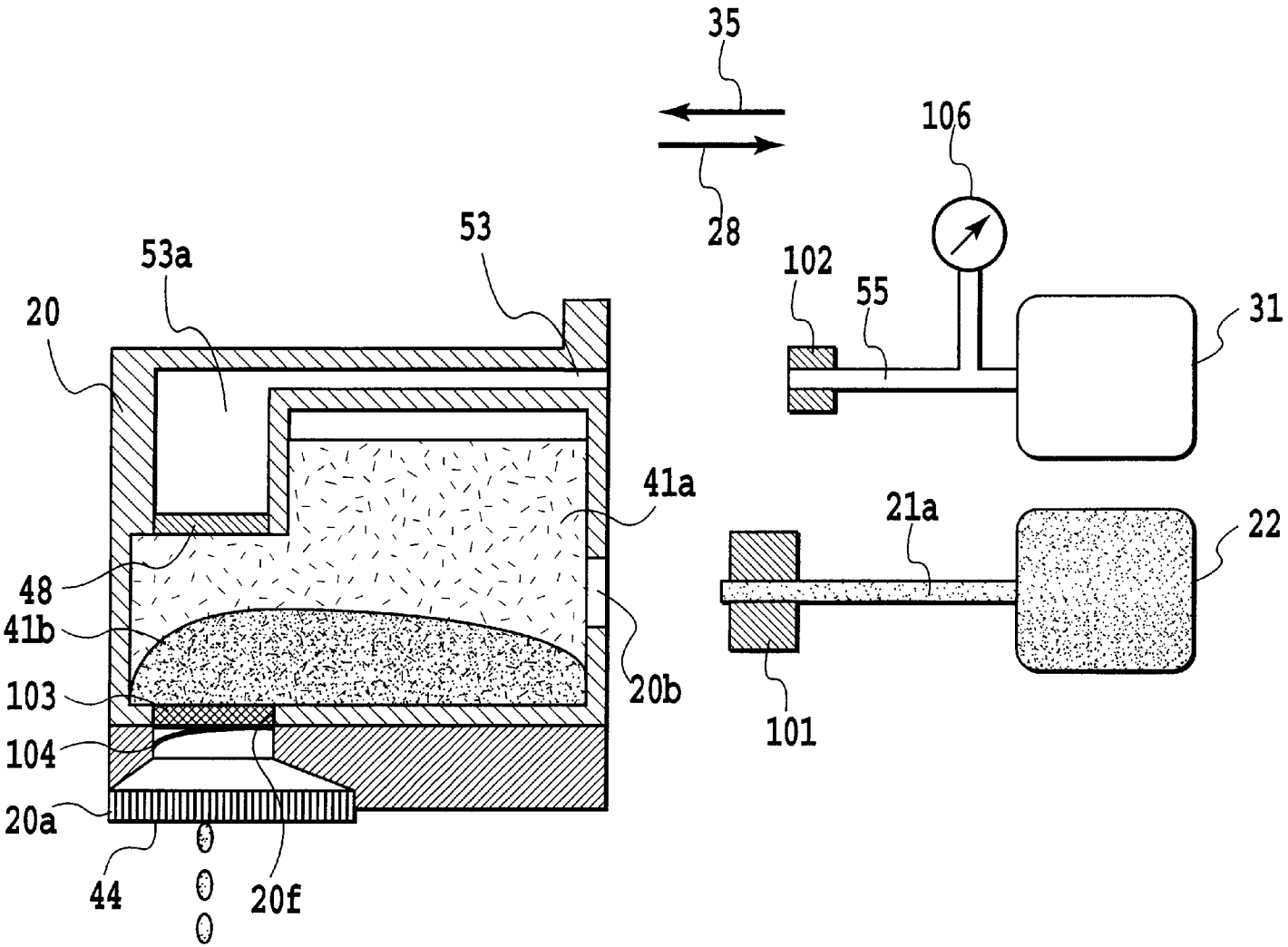
FIG. 1 is a schematic view of the configuration of an integral part of an ink jet recording apparatus according to Embodiment 1 of the present invention.

As shown in FIG. 1, a storage ink tank 20 acting as a sub-ink tank includes an ink jet recording head capable of ejecting an ink, that is, a recording head 20*a* and is removably mounted on a carriage (not shown) of the serial-scan-based ink jet recording apparatus. The recording head 20*a* ejects an ink from an ink ejecting port in a nozzle 44 in the storage ink tank 20 based on image information. The storage ink tank 20 also has an ink supplying port 20*f* for supplying the ink from the storage ink tank 20 to the recording head 20*a*. The nozzle 44 includes an ejection energy generating means generating energy required to eject the ink. Such an ejection energy generating means may comprise an electrothermal converter for generating thermal energy. Furthermore, the carriage (not shown) is moved by an appropriate movement mechanism in the main scan direction shown by arrows 28 and 35. Further, recorded media are conveyed by a transfer means in a subscan direction crossing the main scan direction.

In such a recording apparatus, an image can sequentially be recorded on the recorded medium by repeating a main scan of the carriage with the recording head 20*a* and the storage ink tank 20 mounted thereon and a subscan of the recorded medium.

The storage ink tank 20 has a suction port 53 and an ink intake port 20*b* formed in a side thereof. The suction port 53 is in communication with the interior of the storage ink tank 20 via a suction passage 53*a*, and a gas transmitting member 48 is provided at the site of the opening of the suction passage 53*a* in the storage ink tank 20. The gas transmitting member 48 has, as a gas-liquid separating means, a function of transmitting gases therethrough while not transmitting inks therethrough. For example, the gas transmitting member 48 preferably comprise a thin sheet formed of an ethylene tetrafluorice resin, a similar porous resin material, or the like. Additionally, the storage ink tank 20 has an ink absorber 41*a* accommodated therein, for sucking and holding the ink.

A filter 103 and a valve 104 are provided in the supplying port 20*f*. The valve 104 is shaped like a seat and has its proximal end welded to the filter 103. The valve 104 functions to open and close the supplying port 20*f* depending on the internal pressure of the storage ink tank 20.

Further, the storage ink tank 20 can be connected to a main tank 22 of the recording apparatus main body via a tube 21*a* by means of a supplying joint 101 that is connectable to the ink intake port 20*b*. The joint 101 and a joint 102 are disposed in the recording apparatus main body so as to lie opposite to the ink intake port 20*b* and the suction port 53 in the scan direction 35 of the carriage.

During a recording operation, the valve 104 is open and the ink is supplied from the storage ink tank 20 to the recording head 20*a*, as shown in FIG. 1.

FIGS. 2 to 6 are views useful in explaining an operation of refilling the above described ink tank with the ink.

Figure 2:
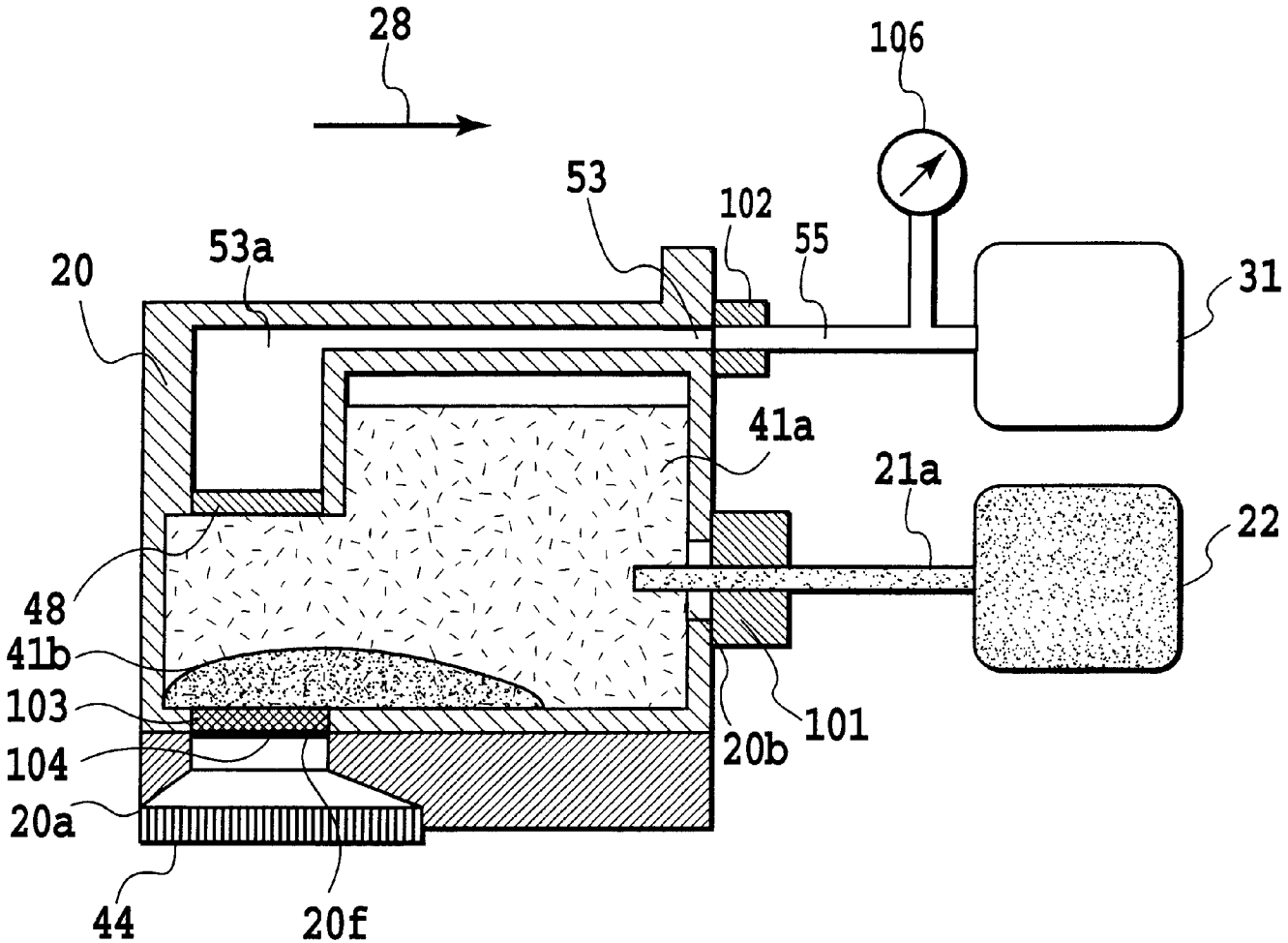
FIG. 2 is a view useful in explaining how the storage ink tank in FIG. 1 is connected to an ink refilling system.

In ink refilling, the carriage is first moved in the direction of the arrow 28 to connect the ink intake port 20*b* and the suction port 53 to the corresponding joints 101 and 102, as shown in FIG. 2. Subsequently, the suction pump 31 performs a suction operation to suck air from the storage ink tank 20 via the gas transmitting member 48 to set the interior of the storage ink tank 20 at negative pressure. The negative pressure in the storage ink tank 20 causes the ink in the main tank 22 to be sucked to the interior of the storage ink tank 20 as shown in FIGS. 3 and 4.

Figure 3:
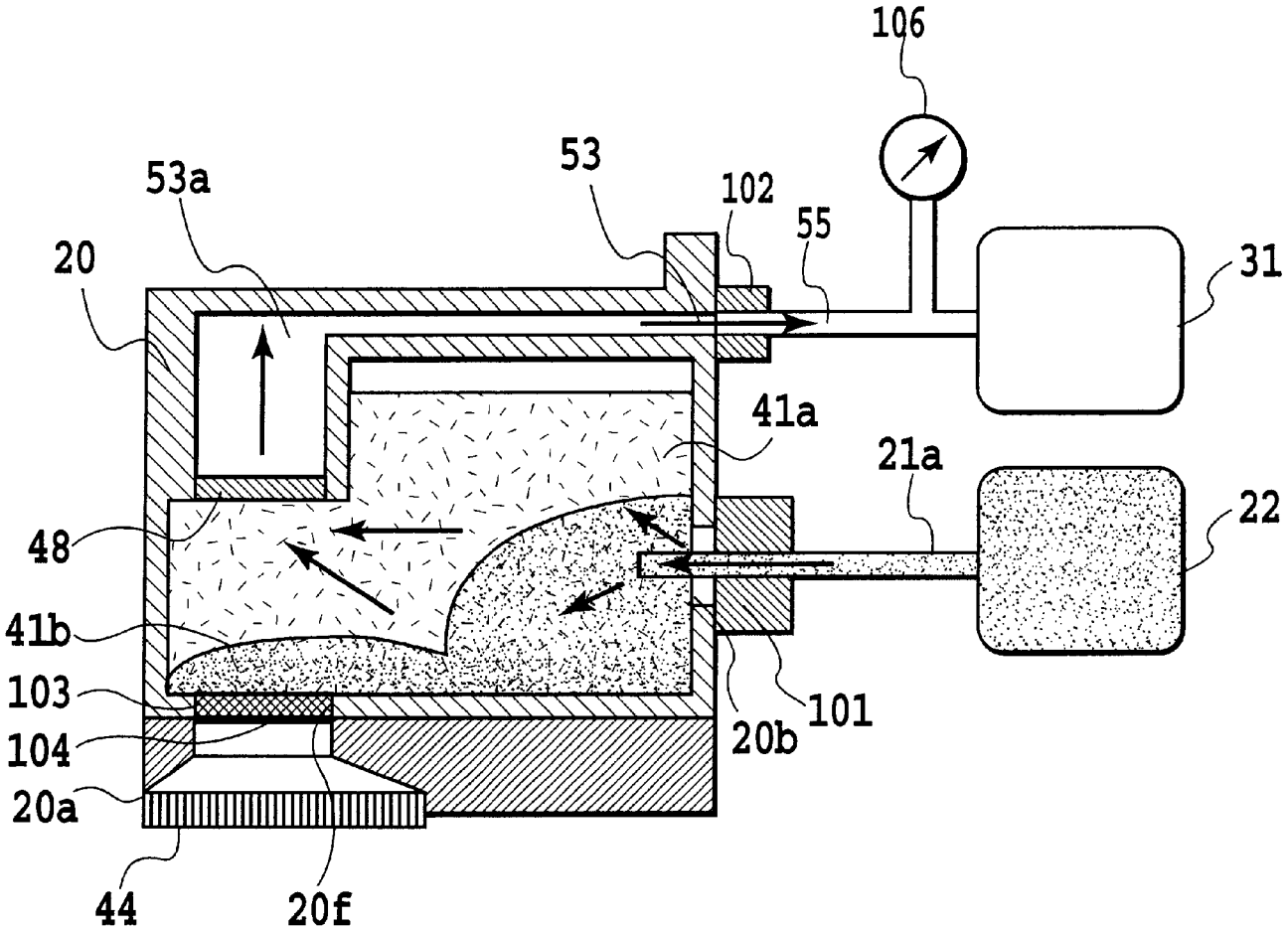
FIG. 3 is a view useful in explaining how the ink tank is refilled with an ink from the ink refilling system in FIG. 1.
Figure 4:
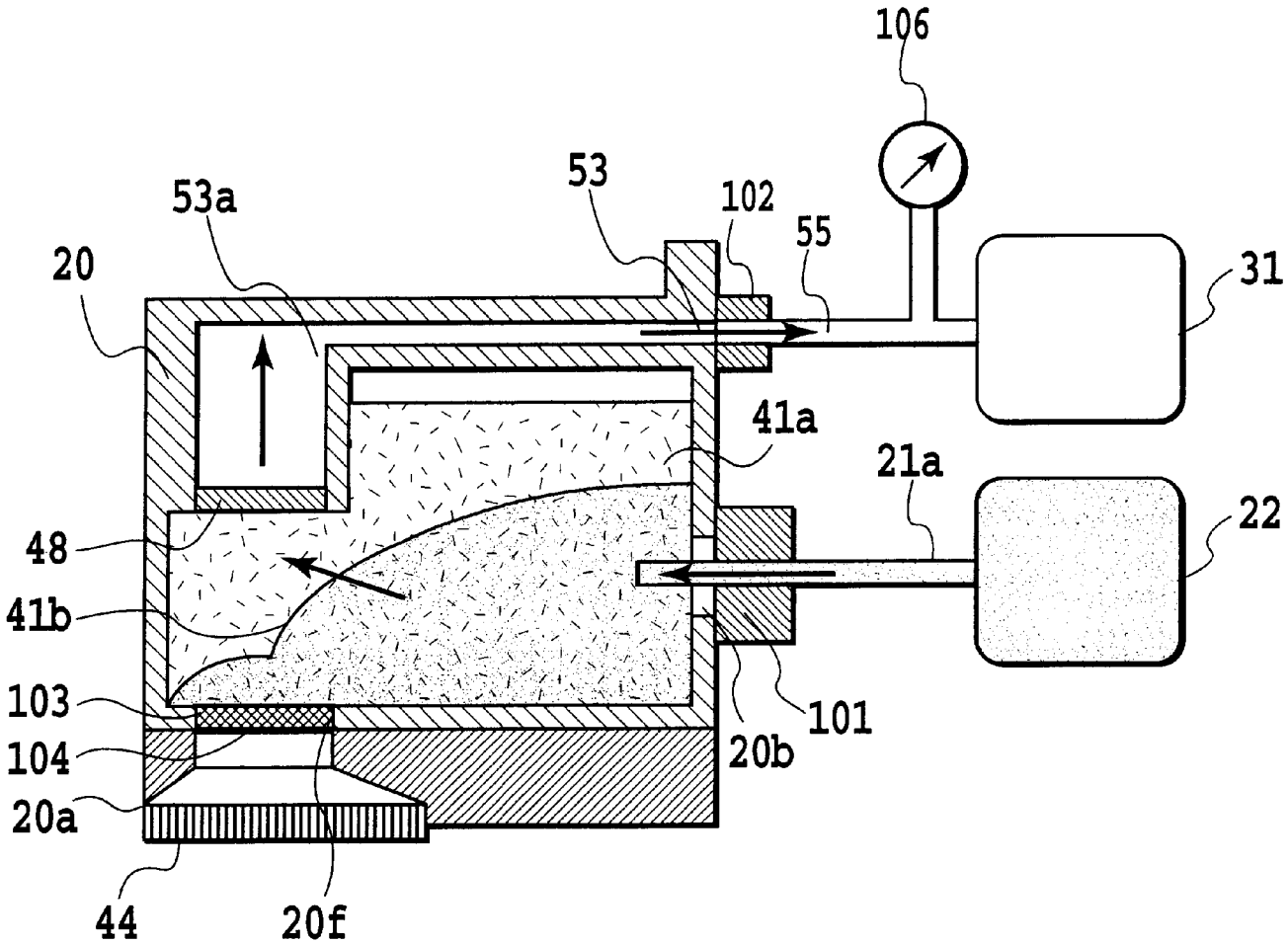
FIG. 4 is a view useful in explaining how the ink tank is refilled with the ink from the ink refilling system in FIG. 1.

In this case, the negative pressure in the storage ink tank 20 causes the valve 104 to close the supplying port 20*f*, as shown in FIGS. 3 and 4. Accordingly, the ink in the recording head 20*a* is not sucked to the interior of the storage ink tank 20, and ink meniscus formed at the ink ejecting port in the recording head 20*a* is not destroyed. Further, air does not enter the recording head 20*a* or the storage ink tank 20 through the ink ejecting port. This ensures that the ink is sucked and supplied to the interior of the storage ink tank 20.

Figure 5:
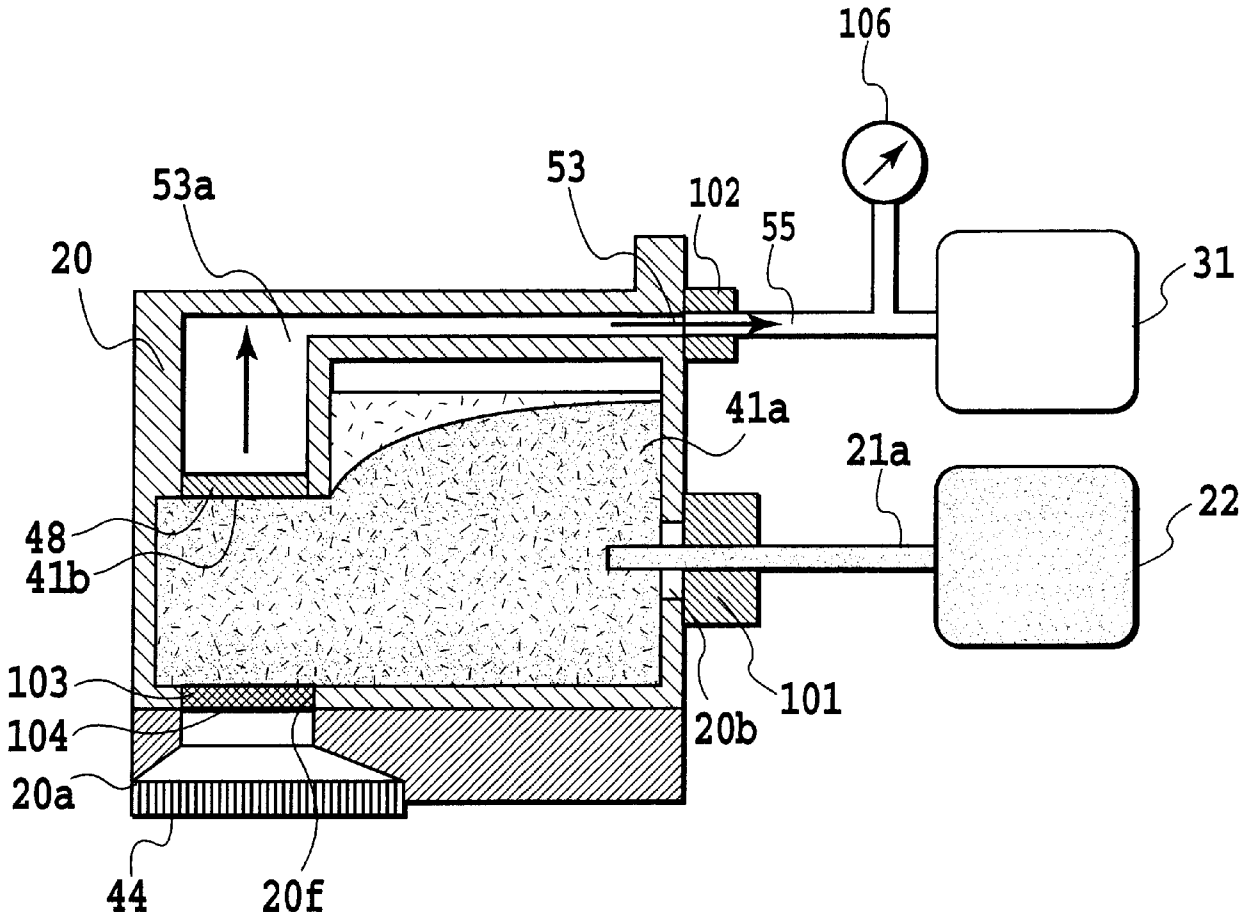
FIG. 5 is a view useful in explaining how the ink refilling by the ink supplying system in FIG. 1 is stopped.

Then, as shown in FIG. 5, when the level 41*b* of the ink in the storage ink tank 20 reaches the gas transmitting member 48, the ink refilling is automatically stopped because the gas transmitting member 48 does not transmit liquids such as inks therethrough.

At this time, however, the negative pressure rises rapidly and persists up to the maximum suction capability of the suction pump 31 unless the latter is not stopped, resulting in excessive negative pressure in the gas transmitting member 48. Thus, a negative-pressure sensor 106 is installed in the middle of a conduit 55 located between the suction pump 31 and the joint 102 so that a drive source (not shown) for the suction pump 31 can be turned off once such a preset negative pressure that the gas transmitting member 48 is not destroyed is reached, thus preventing the destruction of the gas transmitting member 48.

In this example, the gas transmitting member 48 comprises Goatex (a trade name) and has a thickness of 30 $\mu$m, and the negative pressure is set at 0.2 atm. The negative-pressure sensor 106 comprises, for example, a semiconductor or a diaphragm that is displaced under negative pressure, and the negative-pressure sensor 106 is not limited to the position shown in the figure but may be positioned anywhere between the gas transmission member 48 and the suction pump 31.

Figure 6:
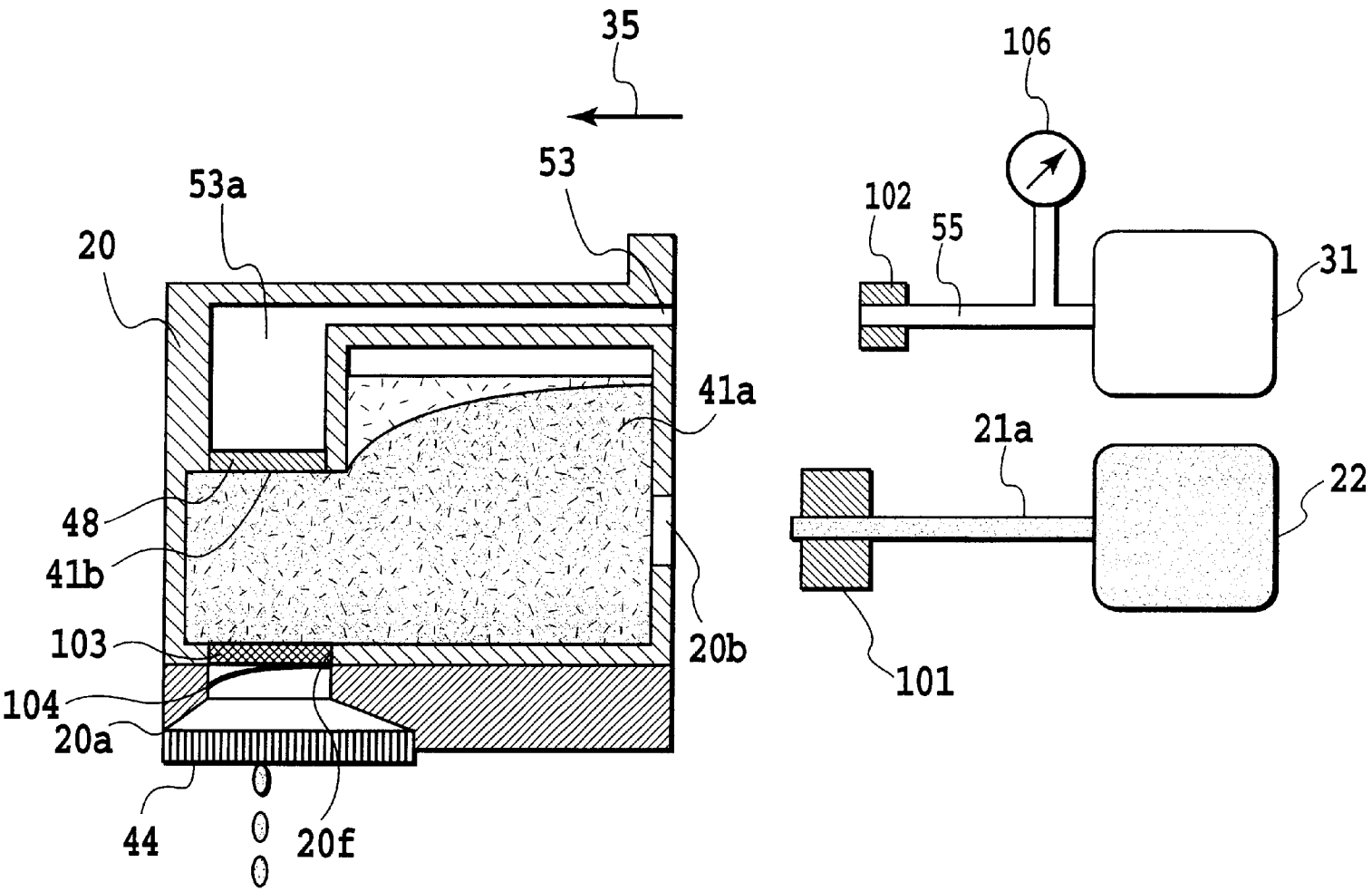
FIG. 6 is a view useful in explaining an operation performed after the ink refilling by the ink supplying system in FIG. 1 has been completed.

Subsequently, as shown in FIG. 6, the carriage 19 moves in the direction of the arrow 35 to separate and remove the ink intake port 20*b* and the suction port 53 from the corresponding joints 101 and 102 to thereby complete the series of refilling operations.

Embodiment 2

Figure 7:
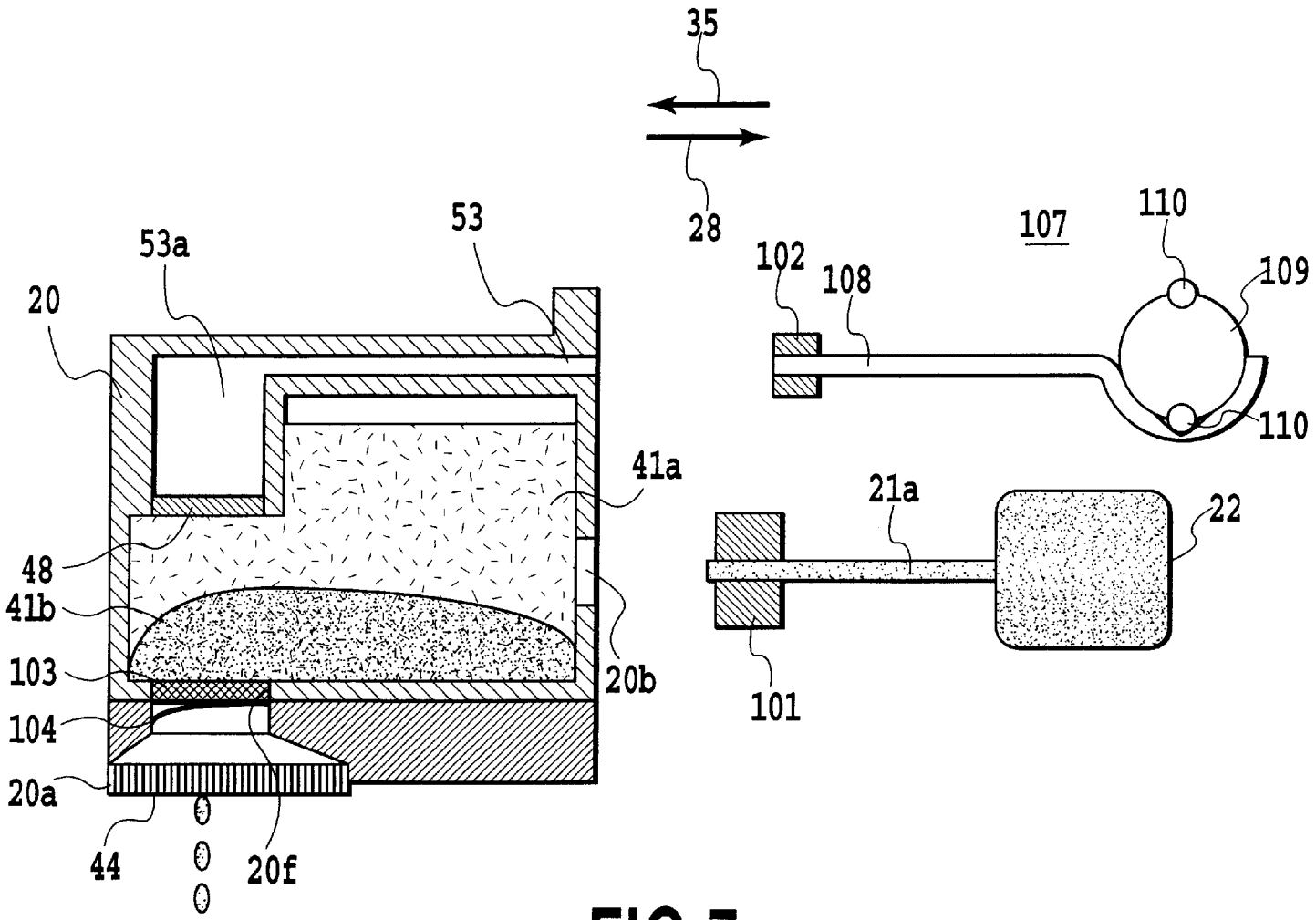
FIG. 7 is a schematic view of a tubeless configuration showing Embodiment 2 of the present invention.

In the above Embodiment 1, the negative-pressure sensor detects negative pressure in the suction system to stop the drive source for the suction pump 31, but in this Embodiment 2, a tube pump 107 is used as the suction pump 31 as shown in FIG. 7. That is, a tube 108 is used as the conduit 55, and a roller holder 109 moves rotationally to cause two rollers 110 rotationally moved integrally therewith to squeeze the tube 108. After the roller 110 has passed through, the tube 108 attempts to recover its original state. At this time, negative pressure occurs in the tube 108. The value of the negative pressure is such that the gas transmitting member 48 is not destroyed. Since, however, the value of the negative pressure is determined by the recovery force of the tube 108 as described previously, the tube 108 remains collapsed at a certain negative-pressure value, which no longer increases, thereby preventing the gas transmitting member 48 from being destroyed despite the driving of the roller holder 109 by the drive source (not shown).

The arrangement of the roller 110 at the opposite position prevents the negative pressure in the tube 108 from reaching the atmospheric value to provide an efficient pump form. Further, the material of the tube 108 is preferably Tygo (a trade name) of a vinyl chloride or is formed of silicon or the like.

In this sequence, to stop the tube pump 107, the driving by the tube pump 107 is turned off once the number of rotations required to fill the empty storage ink tank 20 is reached; this number of rotations is determined by the volume of the storage ink tank 20 and the capacity of the tube pump 107.

Embodiment 3

In Embodiment 3, a diaphragm pump 111 is installed in the conduit 108 as a suction pump.

Figure 8:
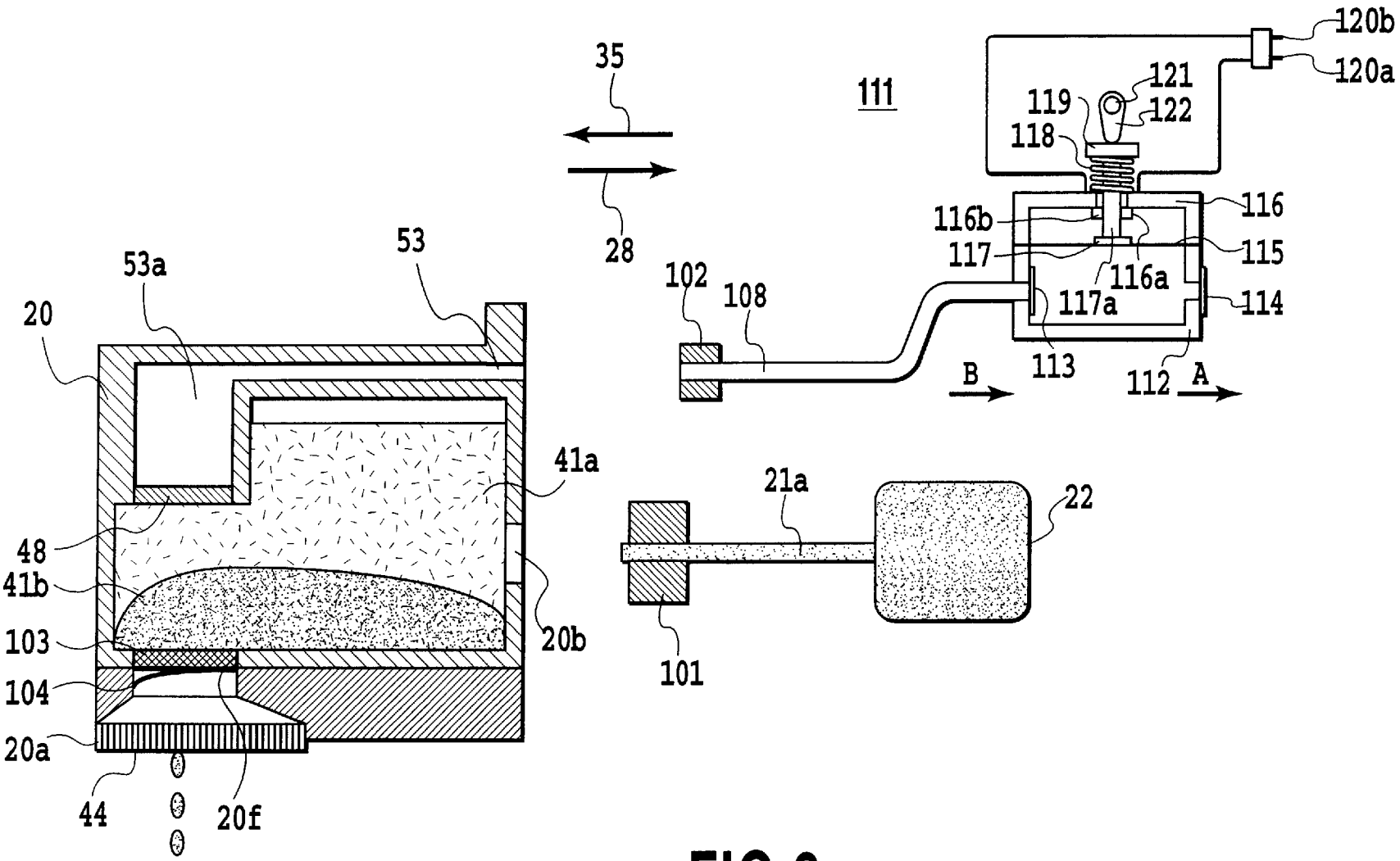
FIG. 8 is a schematic view of the configuration of a diaphragm pump showing Embodiment 3 of the present invention.
Figure 9:
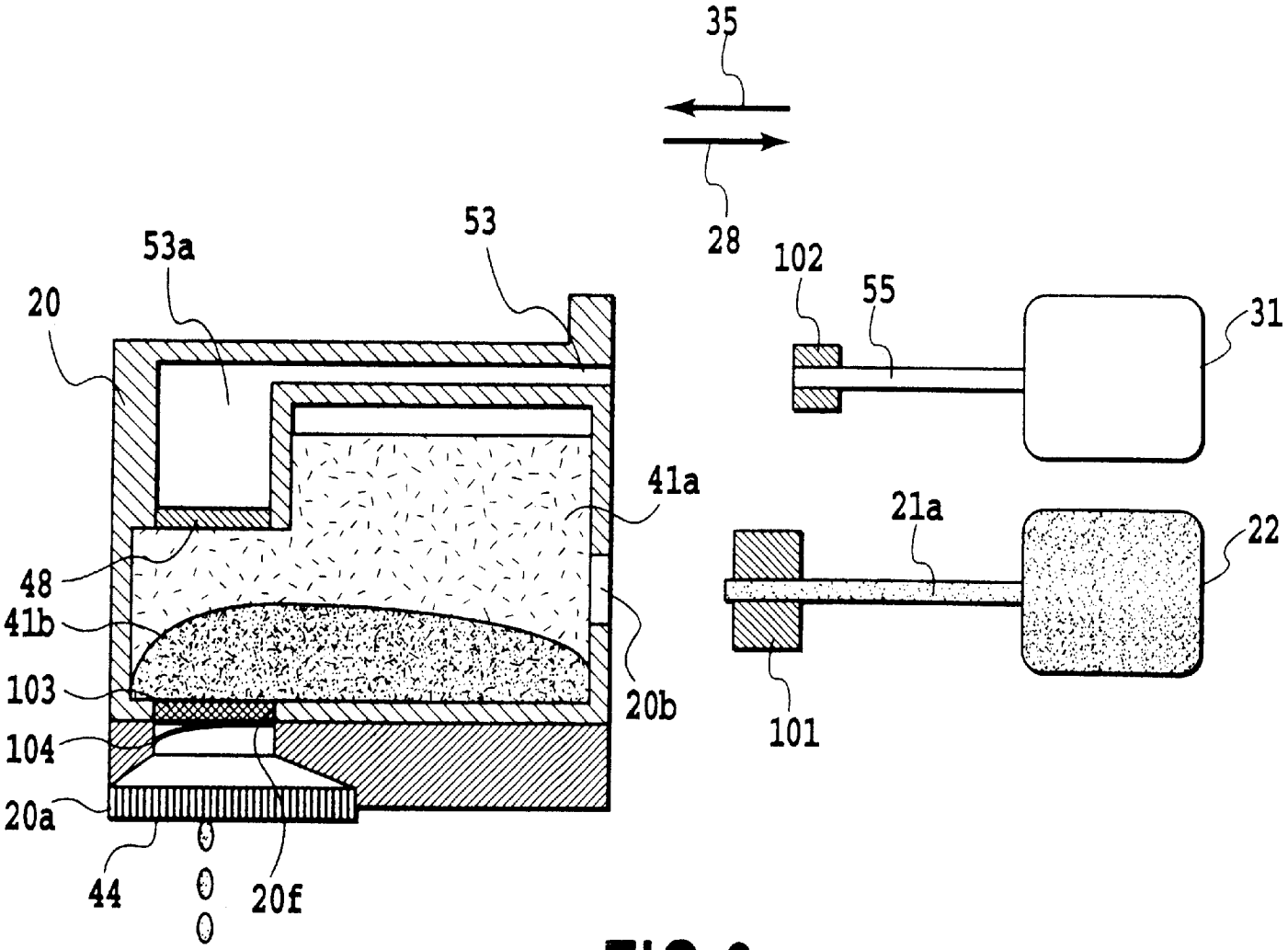
FIG.9 PRIOR ART
FIG. 9 is a schematic view of the configuration of an integral part of an ink jet recording apparatus of a conventional form.
Figure 10:
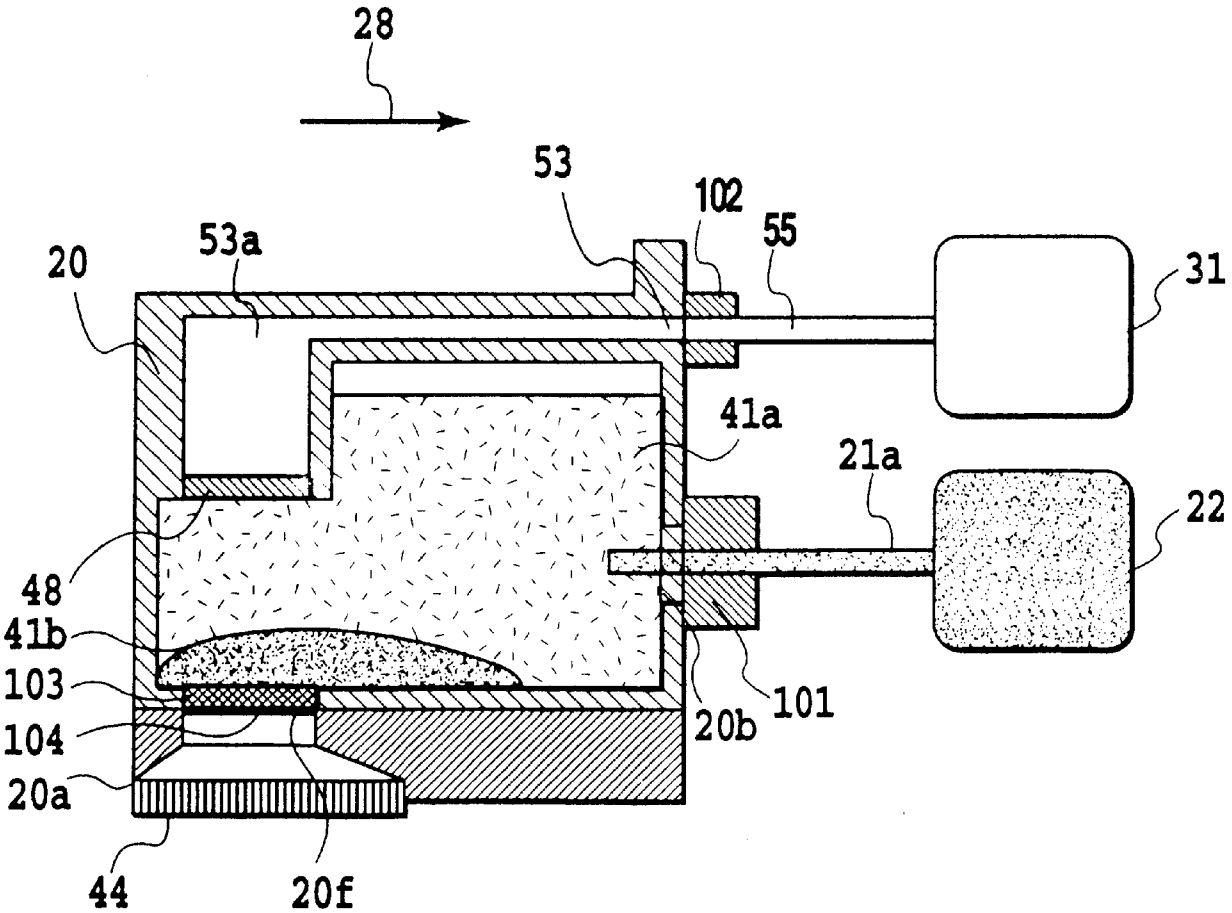
FIG.10 PRIOR ART
FIG. 10 is a view useful in explaining how the storage ink tank in FIG. 9 is connected to an ink refilling system.
Figure 11:
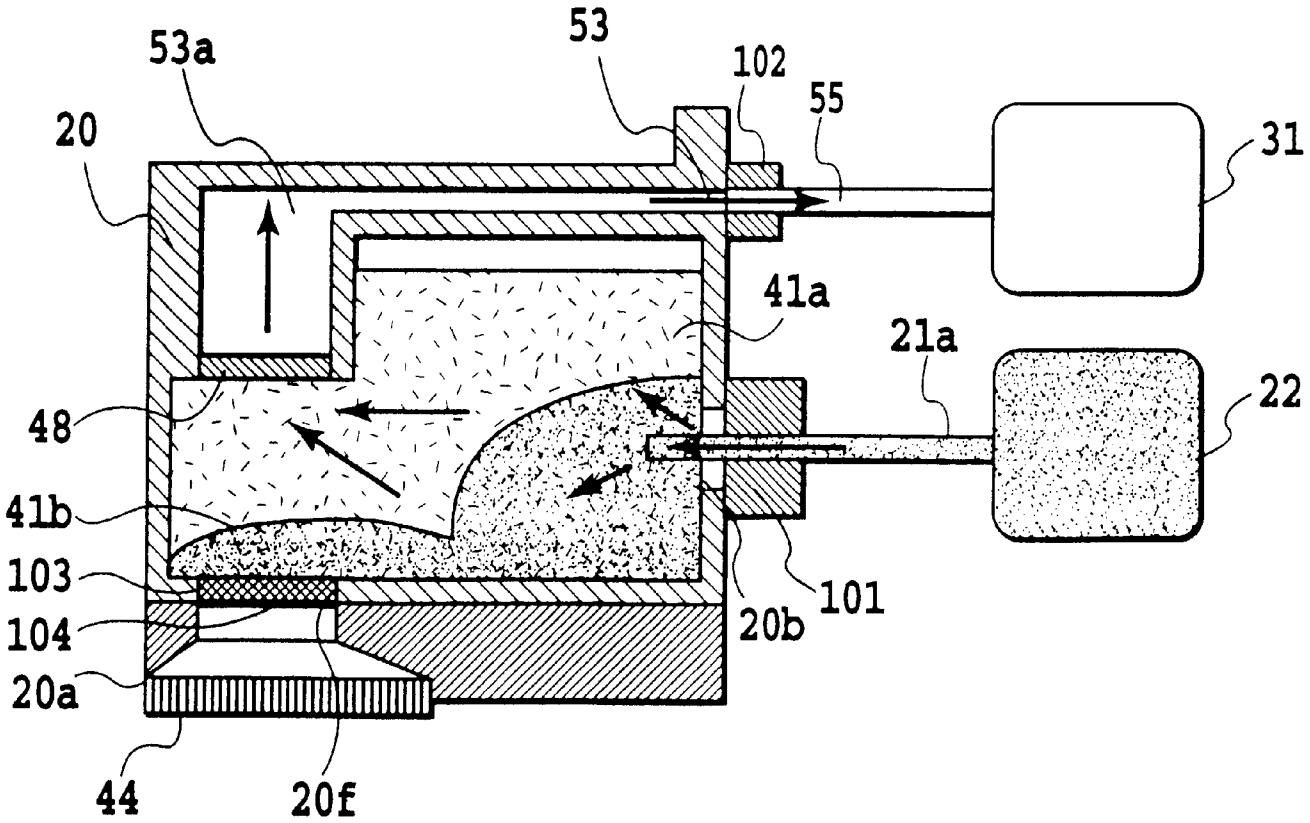
FIG.11 PRIOR ART
FIG. 11 is a view useful in explaining how the ink tank is refilled with an ink from the ink refilling system in FIG. 9.
Figure 12:
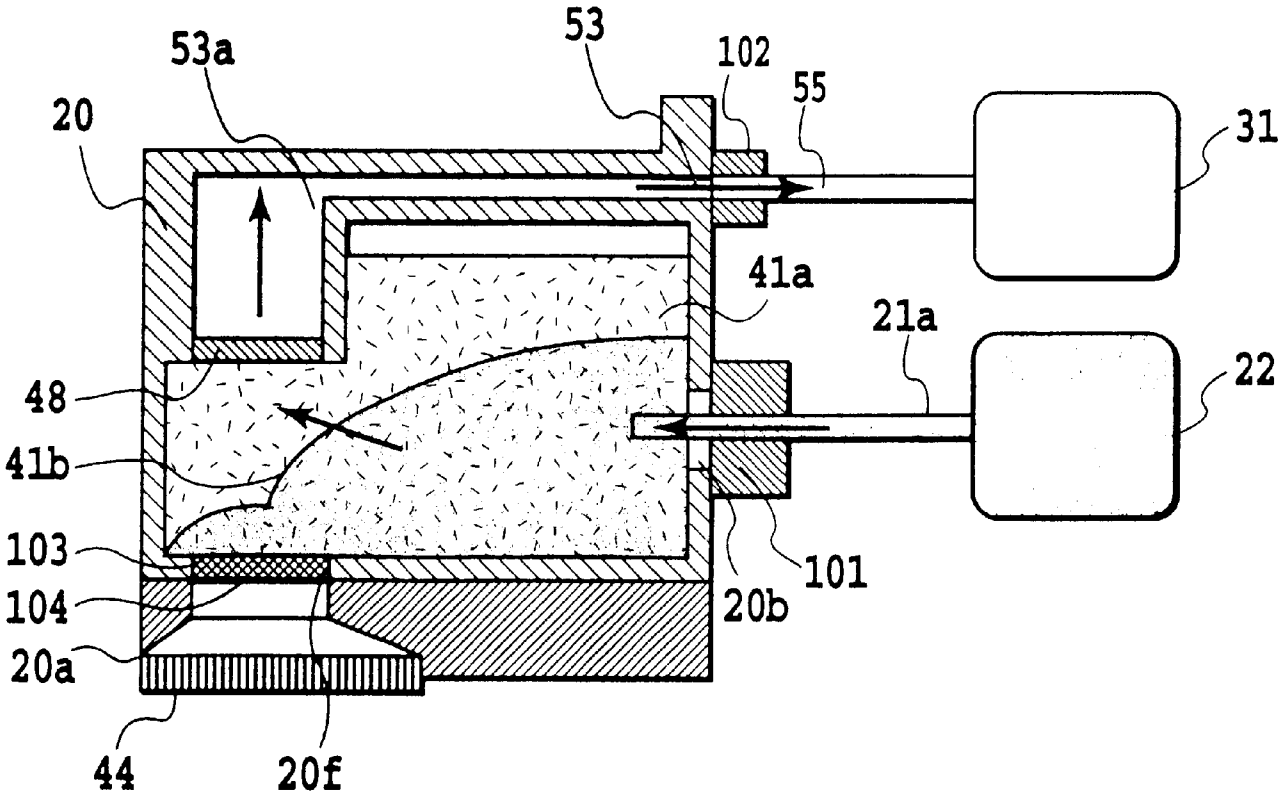
FIG.12 PRIOR ART
FIG. 12 is a view useful in explaining how the ink tank is refilled with the ink from the ink refilling system in FIG. 9.
Figure 13:
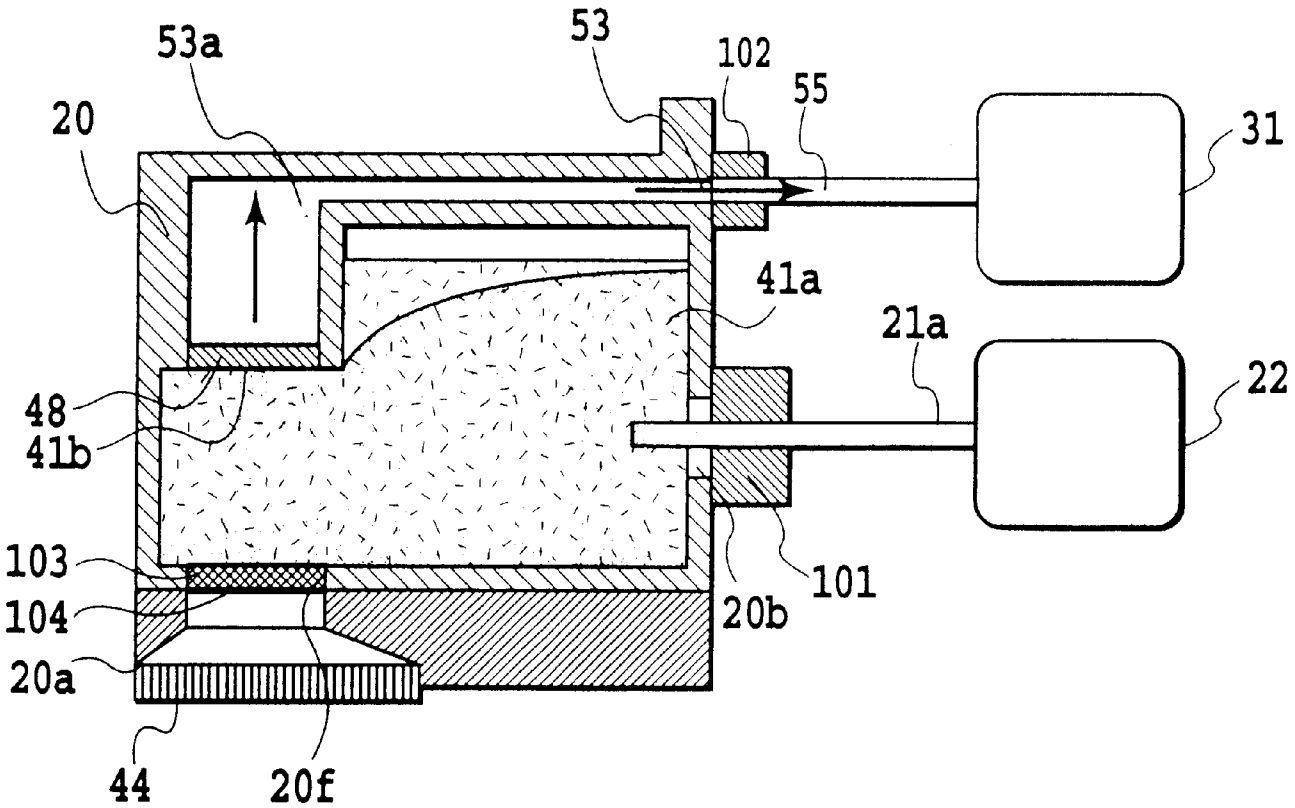
FIG.13 PRIOR ART
FIG. 13 is a view useful in explaining how the ink refilling by the ink supplying system in FIG. 9 is stopped.
Figure 14:
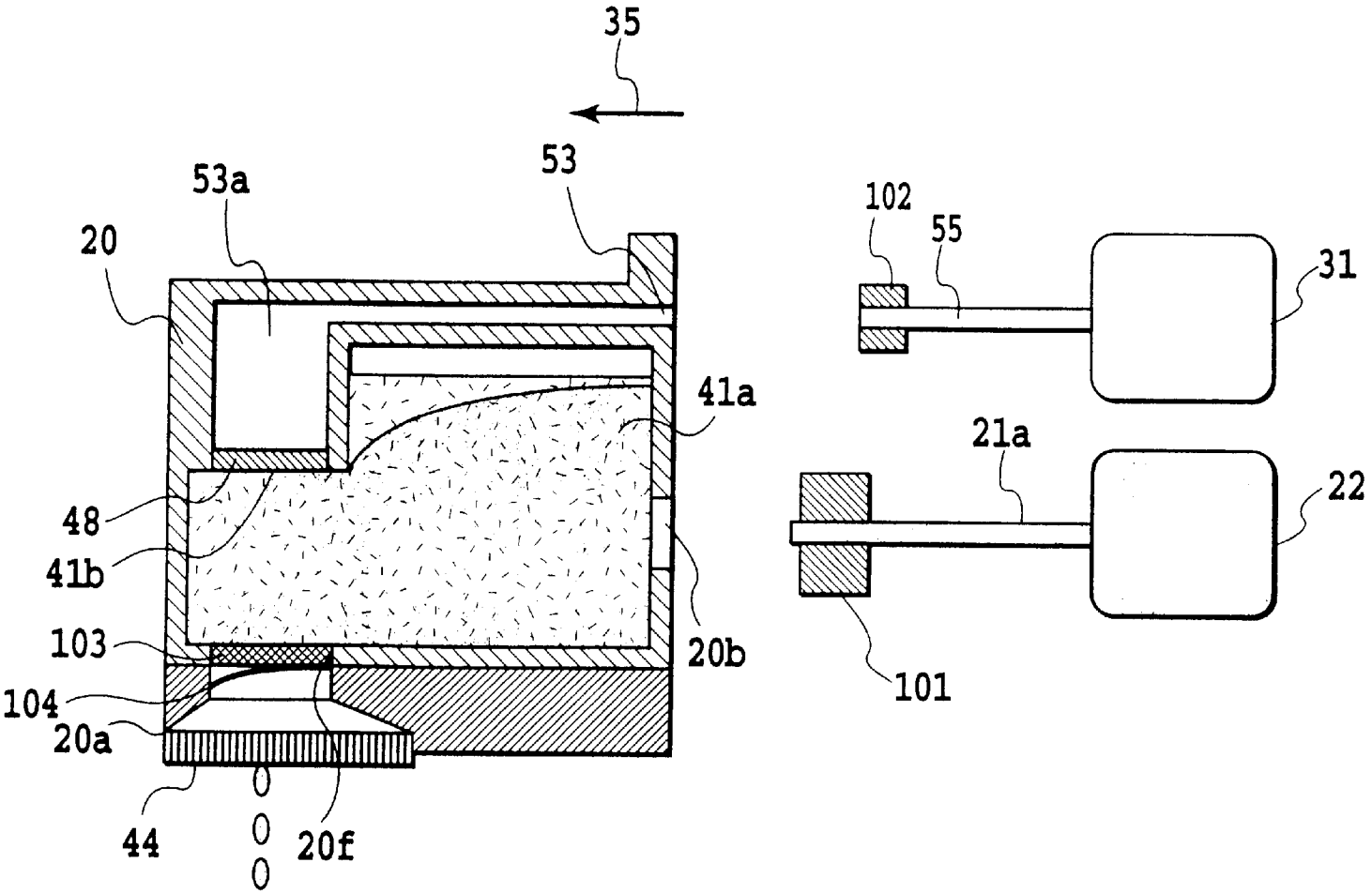
FIG.14 PRIOR ART
FIG. 14 is a view useful in explaining an operation performed after the ink refilling by the ink supplying system in FIG. 9 has been completed.

That is, as shown in FIG. 8, a housing 112 has the conduit 108 attached thereto, and at an end of the conduit 108, a valve 113 is integrally mounted on the housing 112. A valve 114 is provided outside an aperture in the housing 112 which is located opposite to the valve 113. Furthermore, a diaphragm 115 has a conductive diaphragm holder 117 integrally attached thereto, and the tip of a projection 117*a* of the diaphragm holder 117 is threaded. A compression coil spring 118 is installed around an outer periphery of the projection 117*a*, and a stopper 119 compresses the compression coil spring 118. A subhousing 116 has two opposite electric contacts 116*a* and 116*b* welded to an aperture in the center thereof and connected to leads 120*a* and 120*b* connected to a circuit board.

Furthermore, the stopper 119 has a pump cam 122 installed thereon and rotating around a shaft 121. When the pump cam 122 pushes the stopper 119, the diaphragm 115 is displaced downward to open the valve 114, while the valve 113 remains blocked to discharge air in a direction A. On the contrary, when the stopper 119 is relieved from the pump cam 122, the diaphragm 115 rises to set the interior of the pump at negative pressure to open the valve 113, while blocking the valve 114, so that air is sucked in a direction B from the conduit 55 to the interior of the diaphragm pump.

The above operation is repeated to suck air via the gas transmitting member 48 to thereby suck the ink to the interior of the storage ink tank 20. Then, when the ink reaches the gas transmitting member 48 and the tank is then filled with the ink, the negative pressure in the diaphragm pump 111 rises rapidly and the diaphragm 115 thus overcomes resistance force from the compression coil spring 118. Accordingly, the diaphragm 115 remains displaced downward, while the pump cam 122 runs idly, thereby making it no longer possible to suck air. Consequently, the negative pressure is hindered from further acting on the gas transmitting member 48, thus preventing the gas transmitting member 48 from being destroyed. The value of the negative pressure depends on a set value for the compression coil spring 118. This value can be adjusted by the stopper 119, which is threaded. At this time, control may be provided such that the rotation of the pump cam 122 is stopped when the conduction through the leads 120*a* and 120*b* is turned off.

With the above configuration, when the ink reaches the gas transmitting member 48 to raise the negative pressure rapidly, the displacement of the diaphragm 115 is hindered from varying, thereby stopping the sucking to prevent the gas transmitting member 48 from being destroyed. Since the diaphragm also acts as a negative-pressure sensor, no time lag occurs and the diaphragm pump 111 can be stopped.

Suitable materials of the diaphragm 115 include hydrogen nitride butadiene rubber (HNBR), chlorinated butyl rubber, ethylene-propylene-dienta-polymer (EPDM), and the like.

The configuration with only one tank has been described, but for a color ink jet recording apparatus, a plurality of the above configurations may of course be arranged in parallel.

In one form in which the present invention is effectively used, thermal energy generated by an electrothermal converter is utilized to effect film boiling in a liquid to form bubbles therein.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet recording apparatus comprising:

an ink tank having an ink supplying port for supplying ink to an ink jet recording head, an air intake port, an ink absorber for holding the ink, a suction port connectable to a suction pump so as to form a conduit between the suction pump and said ink absorber, and a gas-liquid separator arranged along the conduit between said suction port and said ink absorber, wherein said air intake port is connectable to an ink refilling container for refilling ink into said ink tank in response to suction by the suction pump; and a limiting mechanism arranged along the conduit between said gas-liquid separator and the suction pump, said limiting mechanism for limiting negative pressure generated in the conduit by the suction pump to a value less than that sustainable by said gas-liquid separator.

2. An ink jet recording apparatus according to claim 1, wherein said limiting mechanism is a negative pressure sensor provided with the suction pump.

3. An ink jet recording apparatus according to claim 1, wherein said limiting mechanism is a deformable elastic tube provided with a tube pump.

4. An ink jet recording apparatus according to claim 1, wherein said limiting mechanism is a set value of a compression coil spring connected to a diaphragm constituting a diaphragm pump, the set value being adjustable.

5. An ink jet recording apparatus comprising:

a suction pump;

an ink tank having an ink absorber for holding an ink to be supplied to an ink jet recording head, an ink supplying portion for supplying ink to said ink jet recording head, an ink supply path connection portion for connecting a main tank and an ink supply path as required, a suction path connection portion connectable as required to a suction path which affects a suction condition of said suction pump, and a gas-liquid separating means in a path for connecting said ink absorber and said suction path connection portion; and reducing/releasing means for reducing/releasing a suction pressure of said suction pump exerted on said gas-liquid separating means, wherein said reducing/releasing reduces or releases a suction force caused by said suction pump which continues a pumping operation so as to prevent said gas-liquid separating means from being affected by a pressure of more than a withstand pressure held by said gas-liquid separating means even when an operation of said suction pump continues at the time an ink refilling operation is completed.

6. An ink jet recording apparatus according to claim 5, wherein said reducing/releasing means is a part of said suction pump mechanism.

7. An ink jet recording apparatus according to claim 5, wherein said reducing/releasing means is structured independntly from said suction pump and is placed along said suction path.

* * * * *

UNITED STATES PATENT AND TRADEMARK OFFICE

CERTIFICATE OF CORRECTION

PATENT NO. : 6,637,872 B2
DATED : October 28, 2003
INVENTOR(S) : Yohji Ara et al.

It is certified that error appears in the above-identified patent and that said Letters Patent is hereby corrected as shown below:

Title page,
Item [56], References Cited, FOREIGN PATENT DOCUMENTS, "7-329316" should read -- 7-239316 --.

Column 2,
Line 7, "comprise" should read -- comprises --; and
Line 8, "tetrafluorice" should read -- tetrafluoride --.

Column 7,
Line 47, "comprise" should read -- comprises --; and
Line 48, "tetrafluorice" should read -- tetrafluoride --.

Column 11,
Line 2, "releasing" should read -- releasing means --.

Column 12,
Line 6, "pendntly" should read -- pendently --.

Signed and Sealed this

Sixteenth Day of March, 2004

JON W. DUDAS
*Acting Director of the United States Patent and Trademark Office*